United States Patent [19]

Epps

[11] Patent Number: 5,058,331

[45] Date of Patent: Oct. 22, 1991

[54] HEXO-MODULAR OFFICE FURNITURE SYSTEM

[75] Inventor: Alan L. Epps, Ottawa, Canada

[73] Assignee: Dynamic Custom Equipment Limited, Brampton, Canada

[21] Appl. No.: 458,451

[22] Filed: Dec. 28, 1989

Related U.S. Application Data

[63] Continuation-in-part of Ser. No. 313,739, Feb. 22, 1989.

[30] Foreign Application Priority Data

Feb. 13, 1989 [CA] Canada ..... 590861

[51] Int. Cl.[5] ..... E04B 2/78; A47B 5/02

[52] U.S. Cl. ..... 52/36; 52/239; 52/282

[58] Field of Search ..... 52/36, 239, 282

[56] References Cited

U.S. PATENT DOCUMENTS

| | | | |
|---|---|---|---|
| 3,418,765 | 12/1968 | Propst et al. | 52/239 |
| 3,425,171 | 2/1969 | Propst et al. | 52/36 |
| 3,451,183 | 6/1969 | Lespagnol et al. | 52/282 |
| 3,553,916 | 1/1971 | Lickliter et al. | 52/239 |
| 3,691,709 | 9/1972 | Ostborg | 52/239 |
| 3,762,116 | 10/1973 | Anderson et al. | 52/239 |
| 3,834,092 | 9/1974 | Whisson | 52/282 |
| 4,535,577 | 8/1985 | Tenser et al. | 52/221 |
| 4,771,583 | 9/1988 | Ball et al. | 52/239 |
| 4,831,791 | 5/1989 | Ball | 52/36 |

*Primary Examiner*—Michael Safavi

*Attorney, Agent, or Firm*—Stanley E. Johnson

[57] ABSTRACT

A modular office furniture system of hexagonal configuration is disclosed provided by walls formed from detachably interconnected posts, beams and panels. The hexagonal configuration provides efficient work space for workers and is laid out on a simple equilateral triangular grid. There can be anything from a single module to a multiplicity of modules arranged in groups or clusters. Visual and acoustic privacy is provided by acoustical panels, stackable one on top of the other and slidable into grooves on spaced apart posts. The posts have a lower portion to which there is attached a beam and such beam is grooved to receive an edge portion of the panel that provides the work surface. File and storage systems and shelves are mounted on the acoustical pad panels. Provision for electrical and communication wiring is provided in concealed channels through the beams and hexagonal posts. Hexagonal shaped ambient light fixtures are mounted on selected posts.

13 Claims, 10 Drawing Sheets

HEXO-MODULAR OFFICE FURNITURE SYSTEM

This is a Continuation-In-Part of application Ser. No. 313,739 filed Feb. 22, 1989.

FIELD OF INVENTION

This invention relates to a work space layout system providing small semi-private work stations, to a hexagonal cubicle work confining area defined by detachably interconnected walls defined by posts and beams and having platforms cantilevered therefrom providing a work surface within the cubicle and to panels, posts and beams detachably interconnected providing work area dividers.

The invention particularly concerns a modular furniture system for use as an open office concept that maximizes the use of office space. A plurality of hexagonal work areas referred to herein sometimes as cells and sometimes as modules are clustered or grouped creating a functional working environment with maximum privacy, while at the same time occupying minimum space for each cell which is a private to semi-private work station. A hexagonal module or cell can be used by itself, complete with work surfaces, storage, electrical, computer and telephone provision, lighting, acoustic and visual screening or expansion can be from one module to as many interconnected modules as may be desired to create a complete office environment.

BACKGROUND OF INVENTION

Modular systems for offices, as well as partitions and connecting means therefore to create the same are well-known and by way of example, reference may be had to the teachings of the following:

| U.S. PAT. NOS | ISSUE DATE | |
|---|---|---|
| 3,559,352 | February 2, 1971 | R. A. Magnasin |
| 4,625,633 | December 2, 1986 | M. G. Martin |
| 4,224,769 | September 30, 1980 (corresponding Canadian Patent 1,115,921) | D. C. Ball et al |
| CANADIAN PATENT NO. | ISSUE DATE | |
| 1,150,031 | July 19, 1983 | Douglas C. Ball, et al |

While the known systems are functional, they do not provide flexibility of design nor are they aesthetically appealing nor do they maximize the number and/or user friendliness of private to semi-private work stations, while at the same time minimizing space requirements that are still readily accessible by the users of the system.

Most of the office systems of today are based on a rectilinear format whereby screen panels, furniture and work surfaces line up at 90° corners, creating a lot of unusable space and at the same time fail to create a user friendly environment.

SUMMARY OF INVENTION

In accordance with the present invention, a work space is divided by interconnected walls defined by posts and beams into a plurality of hexagonal work spaces with each work space having a working surface provided by a platform mounted on and projecting from the partition walls. The hexagonal shape provides easy access to the work surface and panel mounted storage systems, as well as providing good acoustic and visual privacy. The hexagonal shape work stations can be readily so dimensioned and laid out that each station provides arm reach accessibility to items of use within the work station. The hexagonal configuration maximizes the usage of space by accommodating more people in the same space than can be done in conventional rectilinear layouts, while at the same time maintaining or even improving the privacy for each work station.

In accordance with one aspect of the present invention there is provided a plurality of interconnected walls defining a work area layout comprising a first group of a plurality of semi-private work stations with each station being a hexagonal cell defined by a plurality of detachably interconnected partition walls, where one wall is angled to the next adjacent wall at approximately 120°, each work station having platforms cantilevered outwardly from the partition walls, providing an upper work surface projecting into the cell at a selected height. Each cell in the group, has one common wall with the next adjacent cell in that group and an opening into each cell, provided by an omitted wall, provides a walk through access to the cell. There is at least one second group of a plurality of work stations as defined above, spaced a selected distance from said first group, providing walk through passages therebetween. The walls preferably have panels extending upwardly from the work surfaces and openings to the ells are preferably so arranged that an occupant in one cell is obscured from view of the opening to another cell, either in the same group or any of the other groups thereby providing a high degree of privacy, while at the same time minimizing the amount of floor area for a maximum number of semi-private work stations.

In accordance with a further aspect of the present invention, there is provided a partitioning system providing one or more clusters of hexagonally shaped, adjoining work defined areas, each with its own entry, from a passage, provided by an omitted wall of the six sided structure, said partitioning system comprising a plurality of lower posts, a plurality of beams with each beam being detachably connected at its opposite ends to respective ones of a pair of spaced apart ones of said lower posts, a first groove in a side face of said beams and platforms having an edge thereof in said groove and projecting therefrom, providing an upper work surface. Perferably there are adjustably positionable feet under the lower posts, permitting fine tuning of the horizontal attitude of the assembled structure. Also preferably there is provided one or more upper posts on selected ones of the lower posts, detachably connected thereto and forming an extension thereof. Such upper posts having a groove in the outer surface thereof extending vertically and one or more filler panels slip fit into said grooves between a pair of spaced apart upper posts, providing visual and/or acoustic barriers for selected ones of the defined work areas. Preferably the beams have a second groove in the upper surface thereof to receive a lower edge portion of the first filler panel, resting thereon.

LIST OF DRAWINGS

The invention is illustrated by way of example, with reference to the accompanying drawings wherein.

DETAILED DESCRIPTION OF PREFERRED EMBODIMENT

Figure 1:
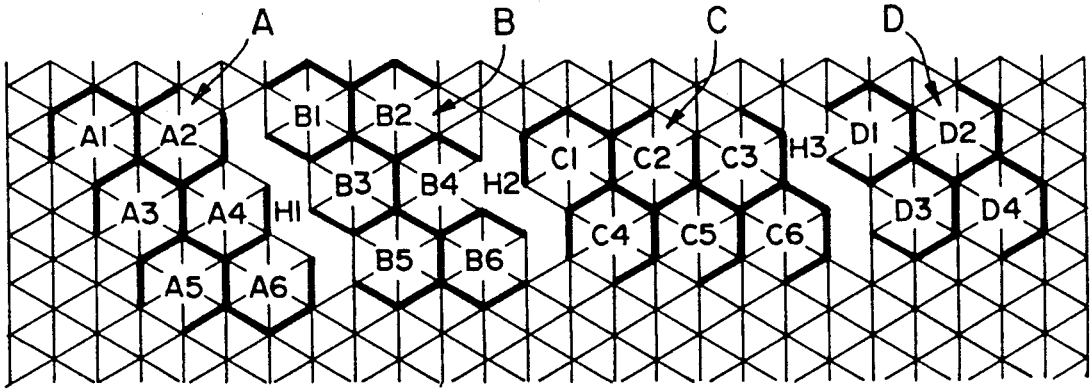
FIG. 1 is an equilateral triangular grid.
Figure 2:
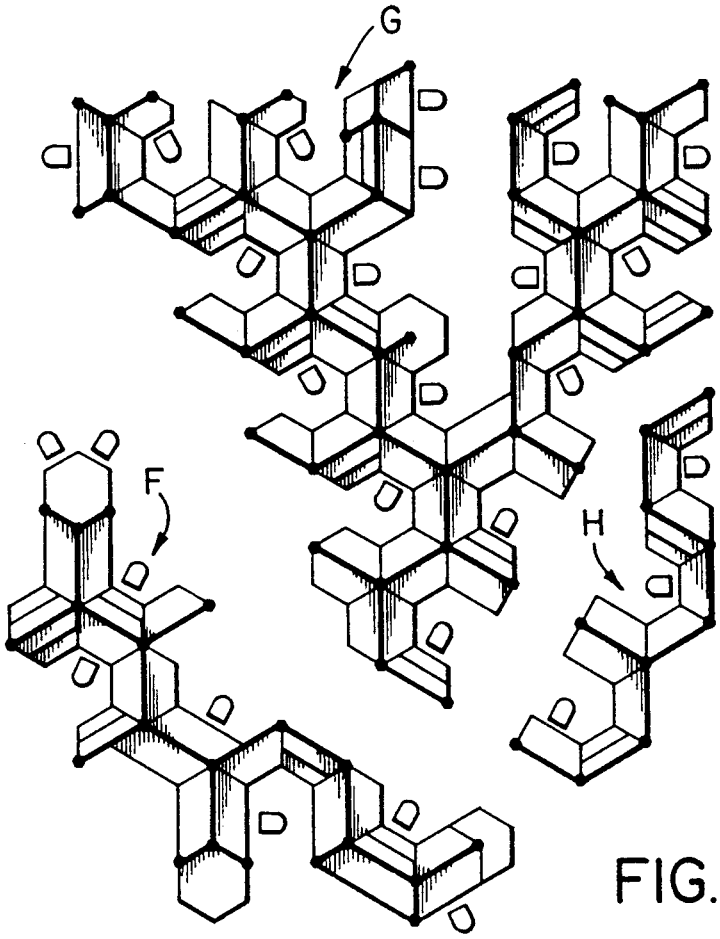
FIGS. 2, 3 and 4 are office layout concepts, using a grid layout of FIG. 1 with hexagonal semi-private office spaces, in accordance with the present invention.

In FIG. 1 there is illustrated an equilateral triangular grid for a portion of a work area and which provides the basis for an office layout system of the present invention. The work area is diagrammatically illustrated as being divided into a plurality of hexagonal cells or semi-private work stations arranged in groups which are separated from one another by hallways or passageways for the workers.

By way of example, FIG. 1 illustrates four groups of work areas designated A, B, C and D, with each group having a plurality of semi-private work stations. In the example, group A has six semi-private work stations, defined by a system of posts, beams and panels to be described in detail hereinafter. The independent or semi-private work stations in group A are designated A1, A2, A3, A4, A5 and A6. Each work station or cell is hexagonal shape with one wall omitted, providing a walk through entry into the work station.

The group B work stations are spaced from group A providing a hallway designated H1 therebetween. Similarly group C work stations are separated from group B by a hallway H2 and group D is separated from group C by a hallway H3. The arrangement can be readily such that the worker at one work station, looking out through the open wall, views only a paneled wall defining the wall of another cell. This provides maximum privacy for each of the workers, while at the same time, there is a feeling of spaciousness for the worker because of the complete open wall.

Dimensioning of the individual cells can also be such as to minimize the floor area, while at the same time, maximizing the number of semi-private work stations and furthermore provide a work station with the tools of the trade at effectively arms reach. Experimentation has shown that a wall length of 1.5 m is very effective, providing a spacial layout that is user friendly and an arms reach accessibility to the work surface and tools of the trade, including paper storage systems, etc.

Each group or cluster of semi-private work stations is made up of a plurality of partition walls, all of which are of the same length and detachably connected one to the next with one wall being at an angle of 120° to the next. The work area is hexagonal with one wall omitted and the height can be varied, depending upon the desired acoustic and/or visual privacy desired.

Figure 3:
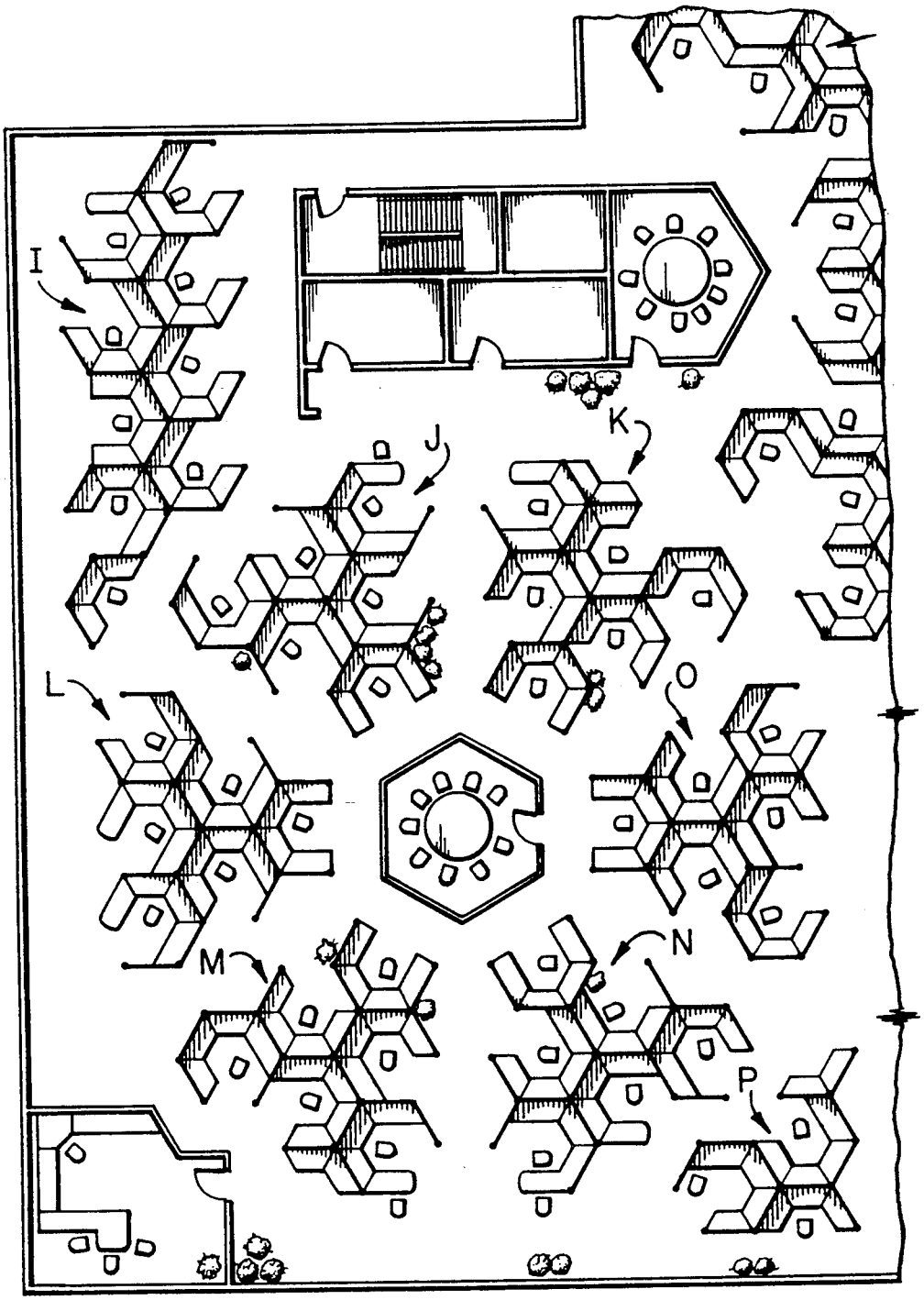
Figure 4:
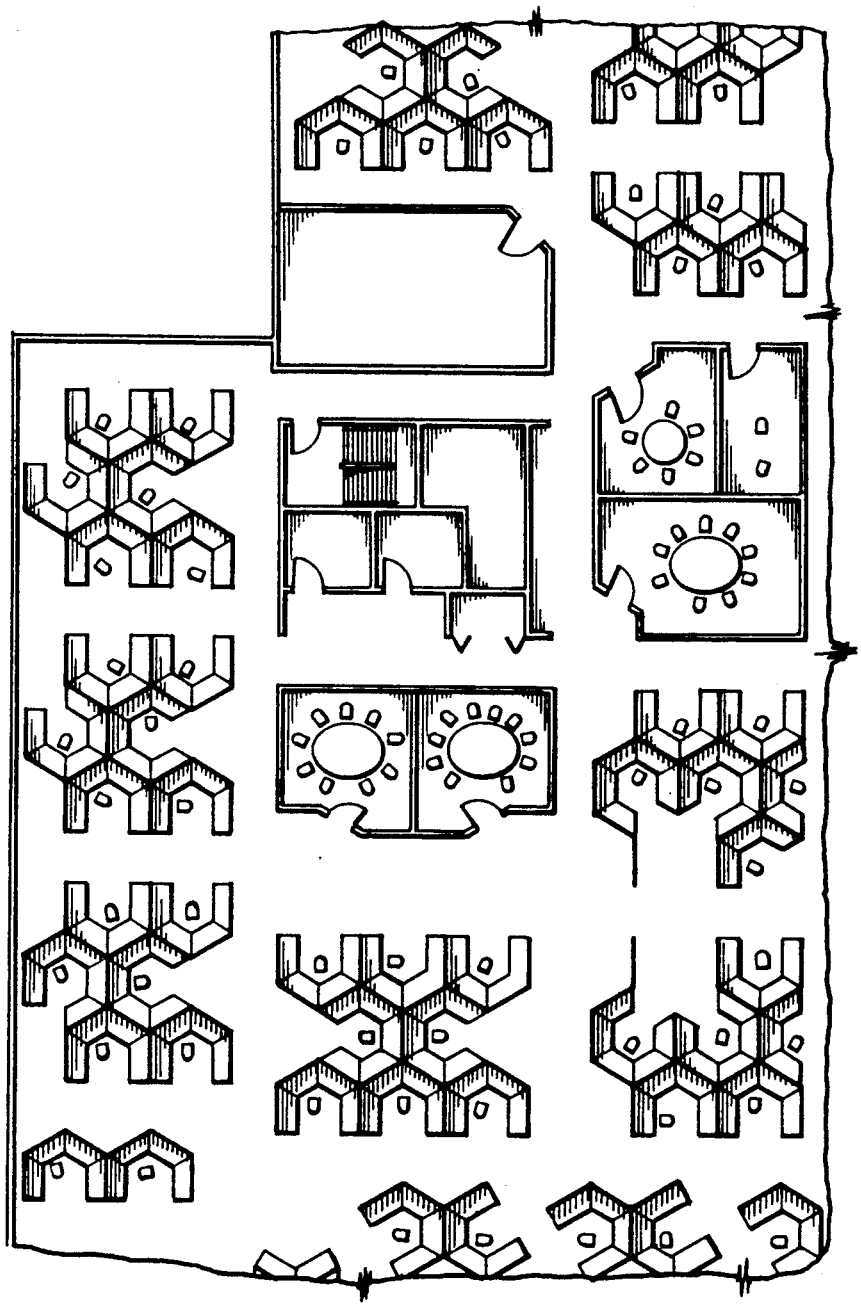
Figure 5:
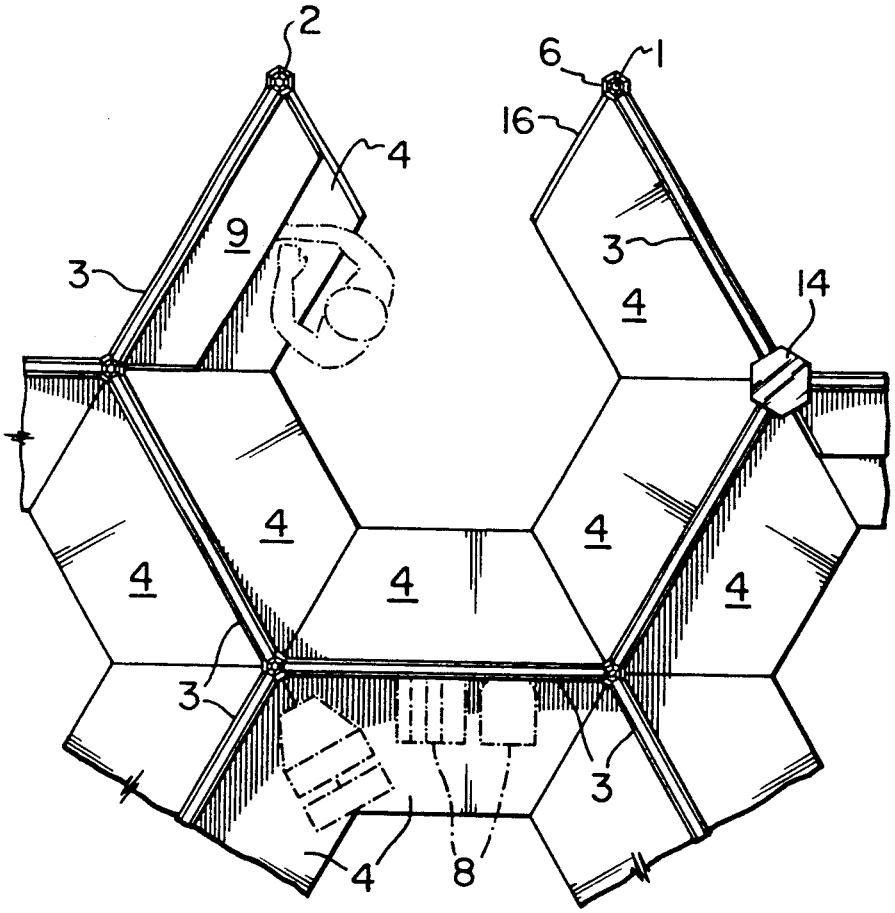
FIG. 5 is a top plan view of a hexagonal module semi-private or work station, provided in accordance with the present invention.

The hexagonal modular open office furniture system of the present invention can function as a single module complete with work surfaces, storage, electrical computer and telephone provision, lighting, acoustic and visual screening or in a group or a cluster of semi-private stations or in a plurality of clusters. Expansion from one to many interconnected modules can create a complete office environment and by way of example, two different layouts are diagrammatically illustrated in FIGS. 3 and 4. In FIG. 3 there are several clusters or groups of semi-private work stations designated I, J, K, L, M, N and O. The layout of FIG. 4 is aesthetically quite different, showing the versatility of applicant's modular system. Common to all layouts is a hexagonal design for each work station with at least one wall of the hexagonal shape being open, providing access or entry into the work station. The hexagonal shape provides easy access to work surface and panel mounted storage systems as well as a fair degree of privacy with at the same time, a maximum number of people in a minimum space.

Each office or work station module, also referred to as a cell, is made up of two primary structural components that are bolted together or detachably interconnected, forming the backbone of the system, these being the lower posts 6 and main horizontal beams 5. From these components, numerous modules can be easily interconnected. Filler panels, also referred to herein as acoustic pads or panels, and upper posts extend upwardly from this structure to the desired height dictated by the user's acoustic and/or visual requirements.

Figure 6:
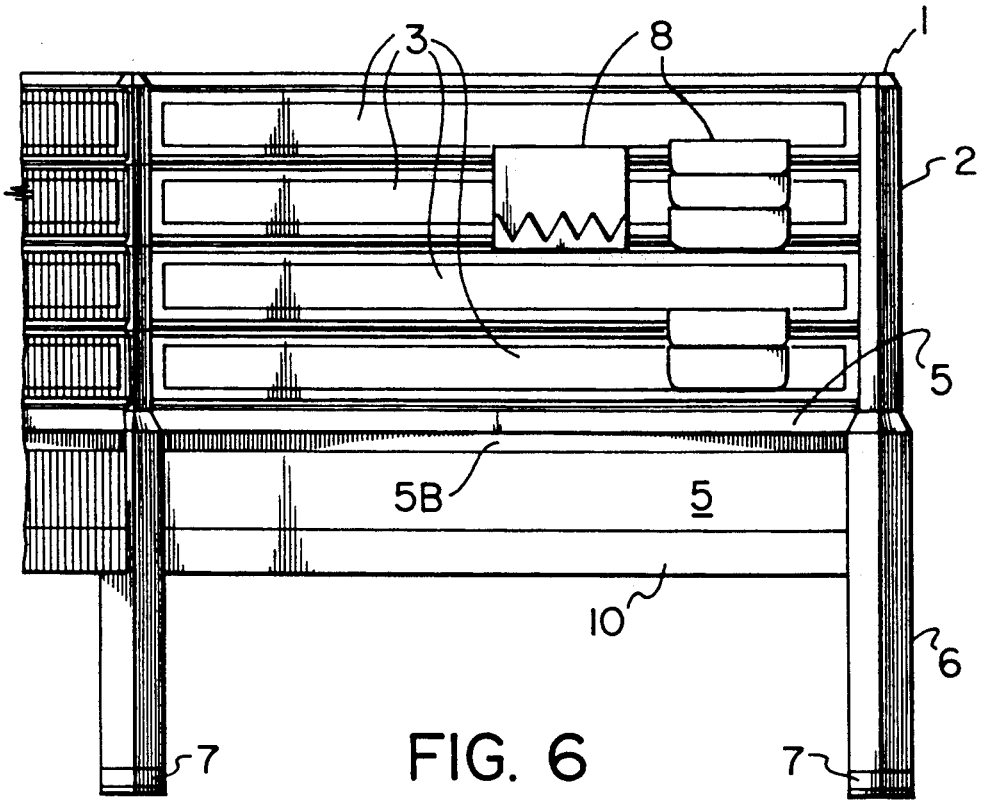
FIG. 6 is a partial elevational view of the modular work station shown in FIG. 5.
Figure 7:
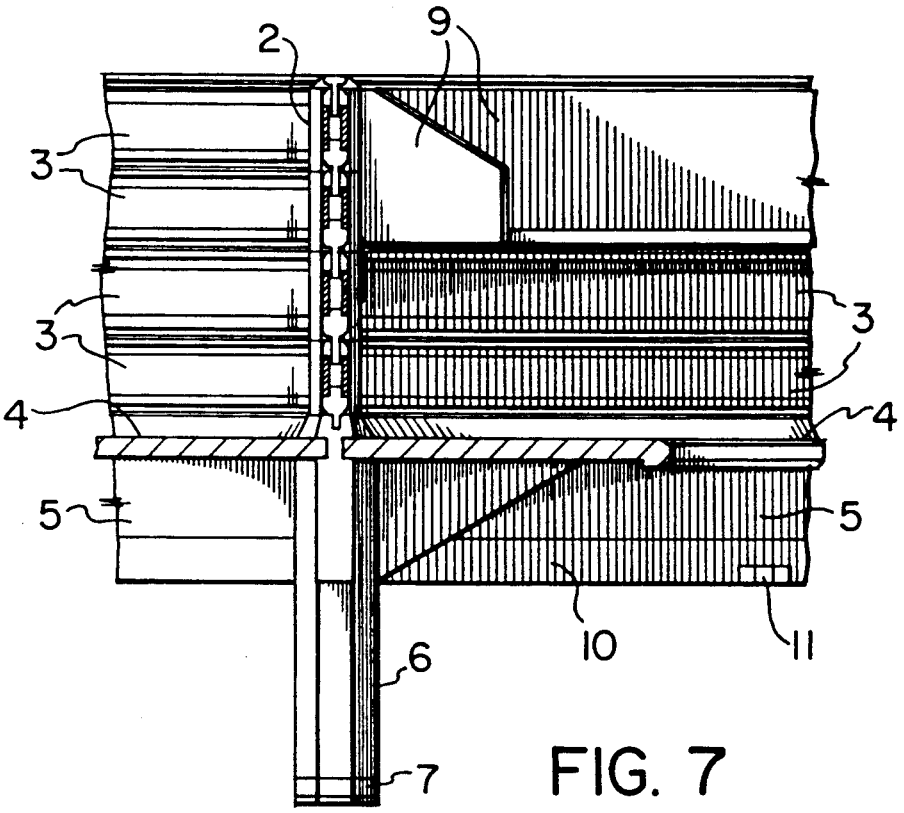
FIG. 7 is a view similar to FIG. 6, in partial section.
Figure 10:
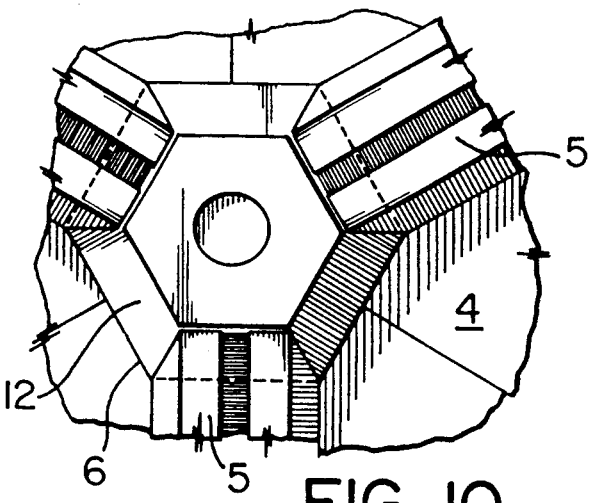
FIG. 10 is a top plan, partial sectional, view of the work surface, lower post and main beam connection.

An upper post 2 is screwed to a lower post 6 and further upper post 2 as required, are added, four in total being shown in FIG. 6 and 7. The number required is determined by the privacy being sought for the individual work stations. The uppermost post 2 has an upper post cap 1 secured thereto to finish the upper end of the post. Acoustic pads or panels 3 (filler panels) have wedge shaped tongues 3A on opposite ends thereof that slip-fit into correspondingly shaped groove 2A in the posts. Reveals in the panels 3 accommodate ladder brackets that support paper management accessories 8 and/or shelves 9. A work surface panel 4 (also referred to herein as a platform) has a back edge thereof that projects into a channel or a groove 5B in the main beam 5 and is cantilevered outwardly therefrom with support being provided by a gusset 13 (see FIG. 15) attached to and projecting from the lower post 6. The edges of the work surface panel, at a completed work station, are finished with a surface edge trim 16. A hexagonal shaped light fixture 14 is secured to one or more of the posts at the top end of the upper post 2 and provides ambient overhead lighting for one to three work stations.

FIGS. 6 and 7 are partial elevational views of a module and in FIG. 6, there is illustrated two lower posts 6 with a main beam 5 secured at opposite ends thereto. This forms the structural backbone. Adjustable levelling glides 7 are screwed to the end of each lower post 6 and are adjustable to tune the horizontal attitude of each module. Within the main beam 5 is a wire access channel 10 to feed necessary electrical telephone and telecommunication wiring required by the user at the work station. In these figures there will be seen there are four upper posts 2, stacked one on top of the other, the lower most one being screwed onto the upper end of lower post 6. The acoustic pads 3 slip-fit into the vertical V-shaped grooves in the upper posts, providing visual and/or acoustic barriers for the work station. Each acoustic or barrier pad 3 is constructed of a preformed metal interior frame, covered or partially covered with aesthetically appealing material with desired acoustical qualities. A shelf 9 is supported by a ladder (two reveals in the acoustic pads), each shelf is designed to butt against an adjacent shelf if required.

Figure 8:
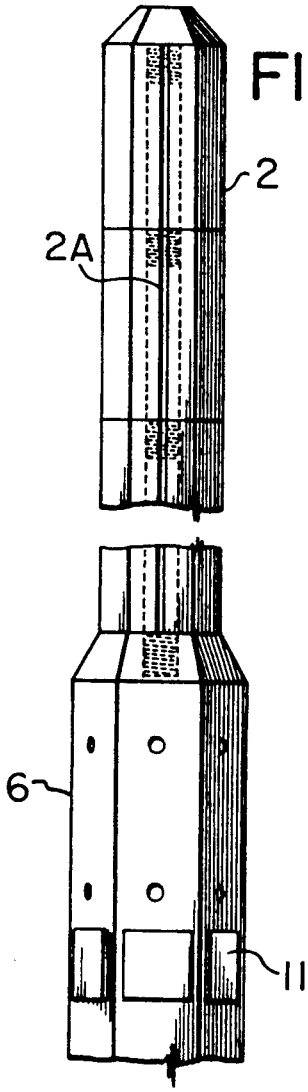
FIG. 8 is an elevational view of a post having upper and lower portions for connecting the panels and beams thereto, providing the partition walls.

FIG. 8 is a vertical enlarged view of a single post consisting of a lower post 6 and upper post 2, stacked thereon. The lower post has wire access channel plugs 11, used to conceal wire feed openings when not in use. The upper posts are screwed together by threaded male/female extruded metal parts.

Figure 9:
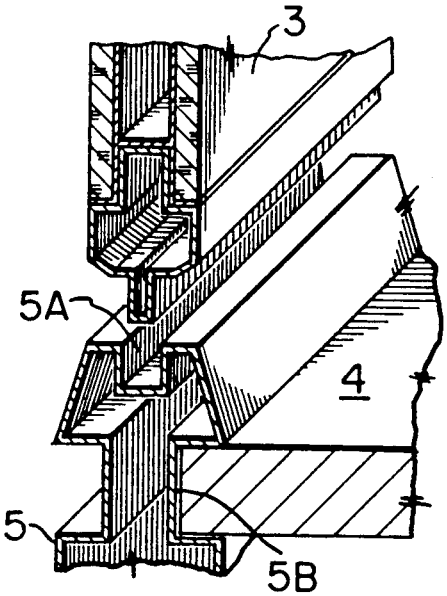
FIG. 9 is an oblique, partial sectional view on an enlarged scale, illustrating the acoustic pad panel and main beam connection.

FIG. 9 illustrates some of the detail of the acoustic pad panel 3, the main beam 5 and platform or work surface panel 4. The main beam 5 has an extruded metal female groove 5A along its top edge to accept the metal male end of the bottom edge of the acoustic pad 3. This male/female joinery allows for simplified installation and removal of acoustic pads without difficulty. The work surface panel 4 fits into a slotted groove 5B that runs the length of the main beam 5 and from FIG. 8, which is a plan cutting the lower post 6 at the connection to the main beam 5, it will be seen three main beams are attached to alternate surfaces of the hexagonal shaped lower post 6. The platform or work surface panel 4 fits within a slotted groove in the main beam, as is clearly illustrated in FIG. 9.

Figure 11:
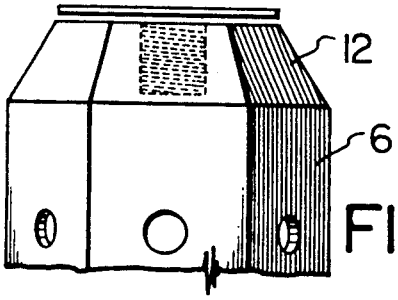
FIG. 11 is a side elevational view of a top portion of the lower post.

FIG. 11 shows there is a lower post plug 12 for finishing the top end of the lower post 6 when the upper posts are not used. In such instance, there obviously would be no upper panels blocking the view of the user of the work station.

Figure 12:
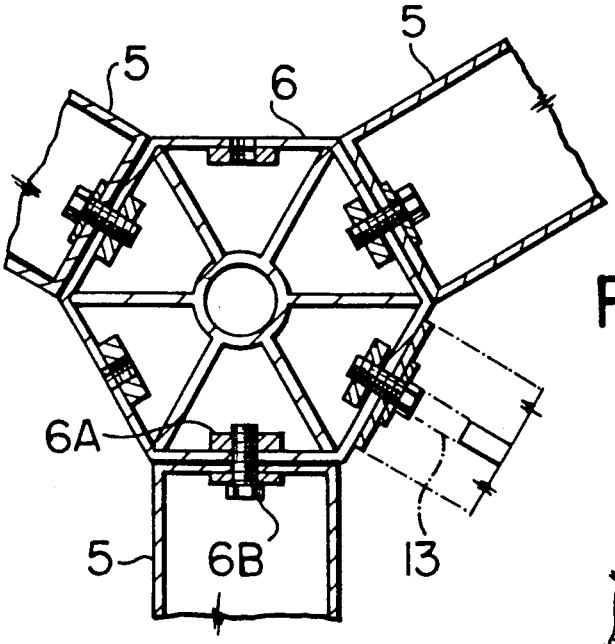
FIG. 12 is a partial top plan, sectional, view of the lower post, cantilever support bracket and main beam connection.

FIG. 12 is a section of the lower post 6 and main beam 5, connection being made by way of a bolt and nut system. Threaded nuts 6A are welded to the inner surface of the lower post 6 and a threaded stud 6B securely attaches the main beam 5 to the post. Support brackets 13 are secured to the lower post 6 in the same manner, such brackets will be seen in FIG. 15, providing a support for the platform or work surface panel 4.

Figure 13:
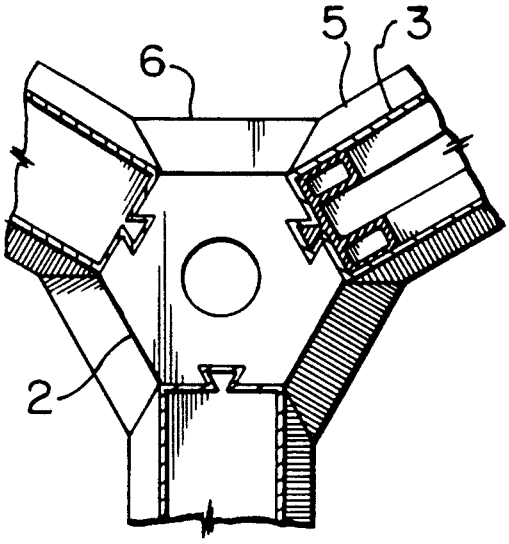
FIG. 13 is a sectional view illustrating connection of the panels to the upper post.

The connection of the acoustic pads 3 to the upper post 2 is clearly illustrated in FIG. 13. The acoustic panels can merely be dropped into place with the bottom one resting on the upper edge of the main beam 5.

Figure 14:
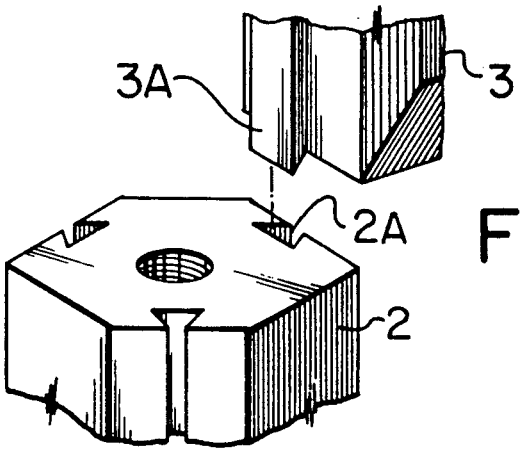
FIG. 14 is an enlarged, broken-away, partial view of the upper post and panel connectable thereto.

FIG. 14 shows the post 2 and panel 3 disassembled prior to the panel being dropped into position. The V-shaped channel and correspondingly shaped tongue 3A on the panel provide a secure fit.

Figure 15:
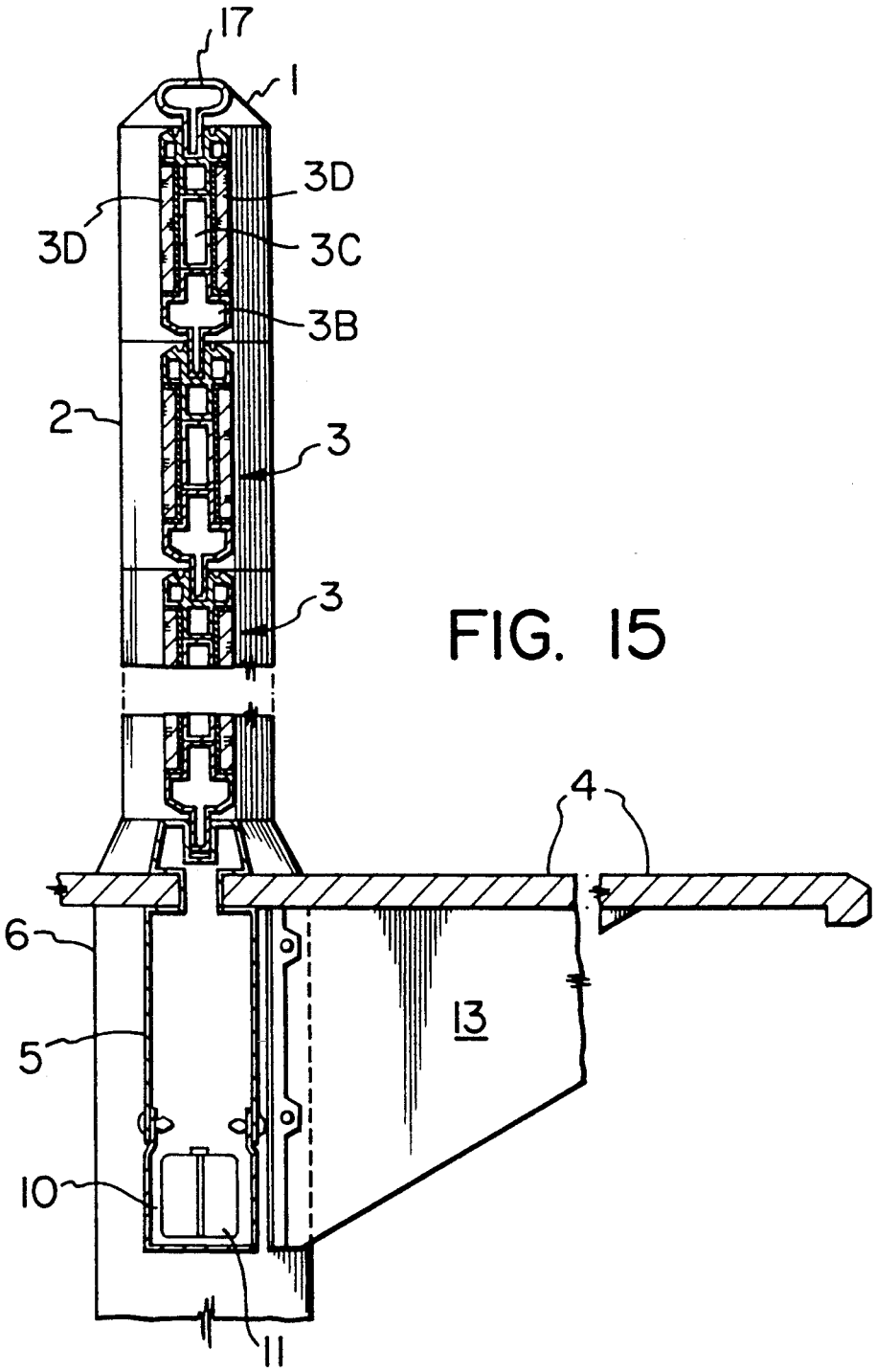
FIG. 15 is a vertical sectional view taken through the main beam and work surface and upper acoustic panels.

FIG. 15 is a detail of the acoustic pads 3 and main beam 5 connection with the acoustic pads being illustrated in cross-section. Each acoustic pad 3 has a peripheral metal frame 3B, a particle board central component 3C and cork board facings 3D. Other facings, obviously, can be used which are aesthetically appealing while at the same time providing the requisite sound deadening function. The acoustic pads 3 run the length of the main beam 5, are connected at their opposite ends to upper posts 2 and the top is finished with an acoustic pad cap 17. This cap runs the length of the acoustic pad 3, butting against the upper post 2 or the upper post cap 1 as the case may be. In the main beam 5, there is a wiring access channel 10 and wiring access channel plugs 11 finish the wire access channel opening in the lower post 6. The bracket 13 is cantilevered from the post and attached thereto by threaded studs and supports the weight and the weight imposed on the platform or work surface panel 4.

Figure 16:
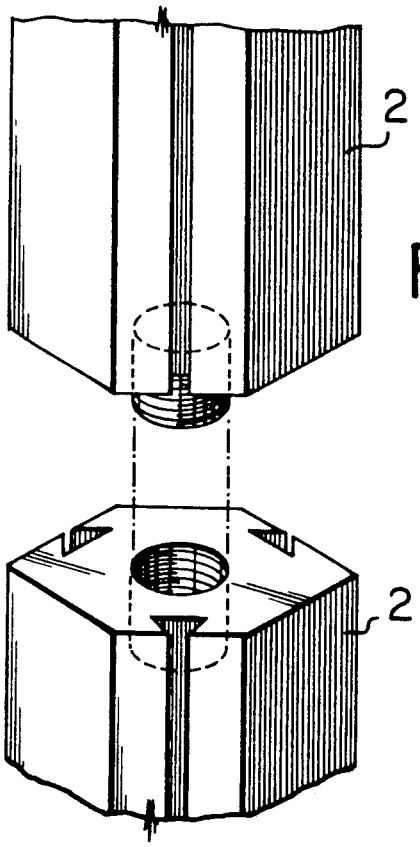
FIG. 16 is an oblique detail view of the connection of the upper posts.

FIG. 16 shows a male/female threaded connection between the adjacent ends of two upper posts 2.

Figure 17:
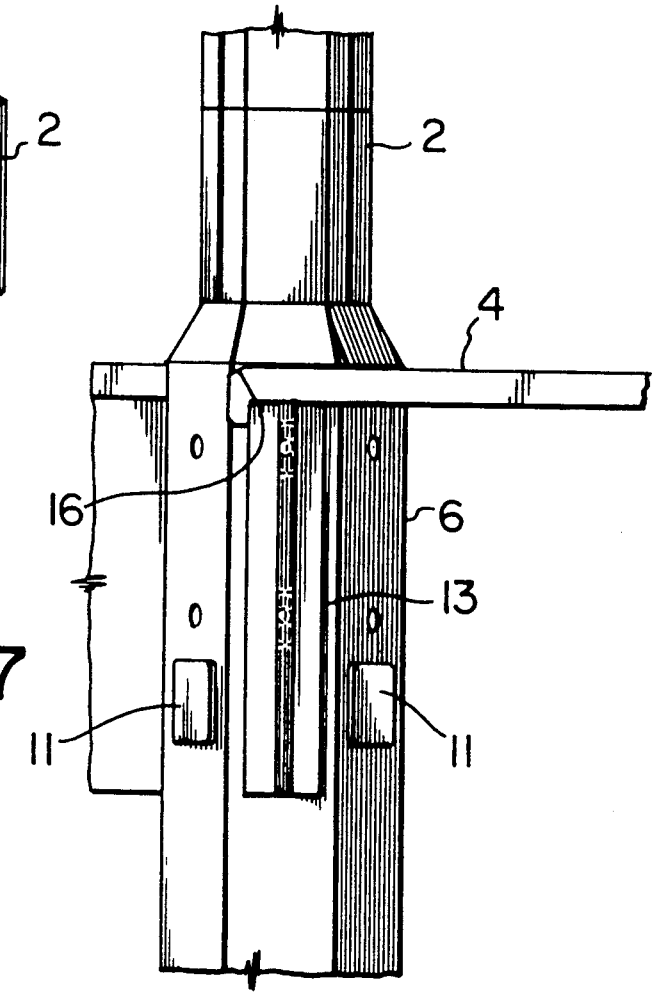
FIG. 17 is an elevational view of the lower post and support bracket connection.

FIG. 17 illustrates, in elevational view, the lower post 6 and bracket 13 connection. The cantilevered support 13 is screwed to the lower post 6 to hold the work surface 4 in place. The work surface 4 is finished at the edges of the modular unit by a work surface edge 16. In FIG. 17 there is again illustrated the wiring access channel plugs 11 that finish the wire access openings in the lower posts when not in use.

Figure 18:
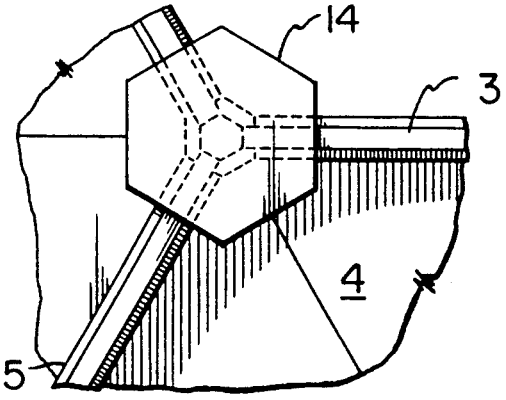
FIG. 18 is a plan view of a light fixture.
Figure 19:
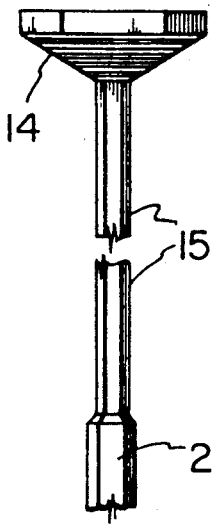
FIG. 19 is a partial elevational view of the lamp fixture shown in FIG. 18.

FIG. 18 illustrates, in top plan view, a hexagonally shaped light fixture at the centre of the intersection of three work stations. The light unit 14 is illustrated in FIG. 19, elevated and supported above the top end of post 2 by a light fixture support post 15. The fixture provides ambient lighting to the work stations below.

Figure 20:
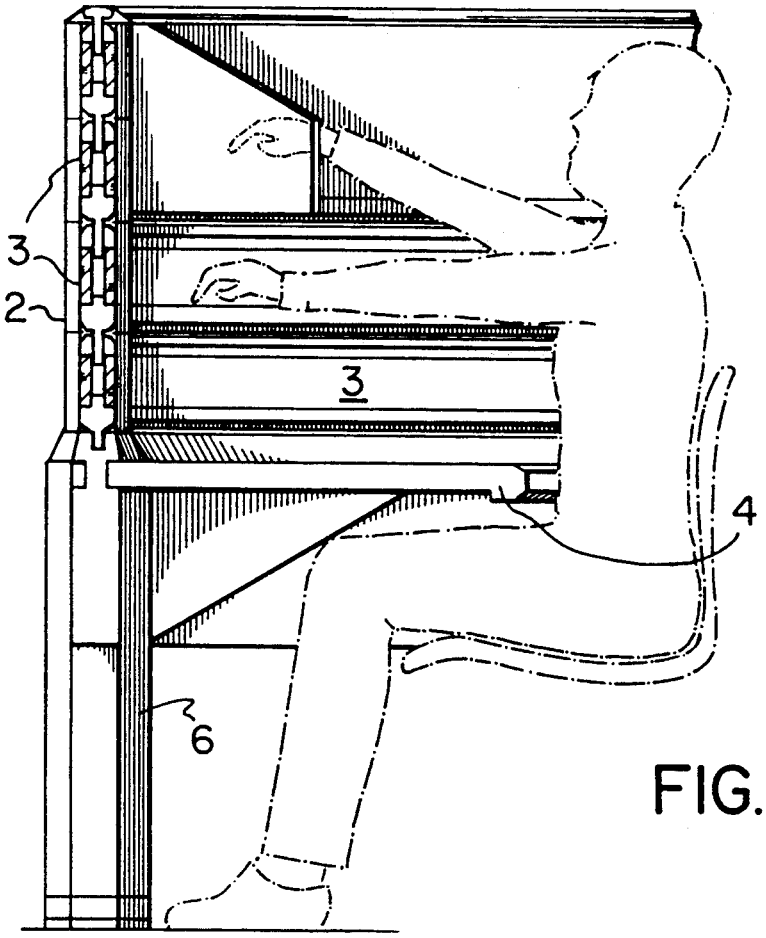
FIG. 20 is an elevational, diagrammatic, view illustrative of the agronomic sizing of a work station.

FIG. 20 diagrammatically illustrates sizing of the work station, providing ready access to supplies and equipment for the user. The work station is composed of the main structural component, consisting of a lower posts 6, main beams 5 and platforms or the work surface panels 4. Upper post 2 and acoustic pads 3 (i.e. filler panels) are added, depending upon the users acoustic and/or visual requirements.

From the foregoing, it will be seen there is provided a modular open office furniture system that maximizes the ergonomic harmony between work surfaces and user. Each office module is based on an equilateral triangular grid, forming hexagonally shaped work stations. These hexagonally shaped modules or cells or work stations, as they are also referred to, can be easily assembled in formations of clusters or groups, creating a space efficient open office environment. The backbone structure consists of a plurality of lower posts and a plurality of beams detachably interconnected.

I claim:

1. A partitioning system providing one or more clusters of hexagonally shaped adjoining work defined areas each with its own entry from a passage, said partitioning system comprising a plurality of lower horizontally spaced, vertical posts, at least one upper post detachably secured to respective selected ones of said lower posts and projecting upwardly therefrom, said upper posts including grooves therein receiving an end portion of a respective one of opposite end edge portions of a removable filler panel, said upper and lower posts being hexagonally shaped in cross-sectional view with the upper posts being of smaller outer cross-sectional dimension than the lower posts, a plurality of horizontal beams with each beam being detachably connected at its opposite ends to a respective one of a pair of spaced apart ones of said lower posts and at a position adjacent on upper end thereof, a first groove in a side face of said beams, platforms having an edge thereof in an associated one of said grooves and projecting therefrom into a defined work area providing an upper work surface therein and a second groove in an upper edge of said beams for receiving a bottom edge portion of a respective one of the filler panels and adjustably mounted feet under said lower posts for fine tuning the horizontal attitude of the assembled system.

2. A work station layout and a plurality of interconnected wall partitions defining the same comprising:

a first group of a multiplicity of defined work stations with each station being a multi-walled cell defined by a plurality of detachably interconnected walls, each of said interconnected walls comprising a pair of lower posts, a pair of upper posts, a beam and at least one filler panel, said beam being secured at opposite ends thereof to said lower posts and wherein a single lower post serves as one of said lower posts at adjacently disposed ends of walls interconnected with one another, said walls being arranged with one wall angled to the next adjoining wall at an angle of about 120°, said upper posts being secured to respective selected ones of said lower posts and projecting upwardly therefrom, said filler panels extending from one to the other of two adjacent upper posts of a cell wall, said filler panels providing sound and/or vision barriers for the occupants of the cells, said filler panels comprising a metal frame having a tongue, on the lower edge thereof, extending the length of the panel and projecting into a groove on an upper edge of the beam for the wall associated therewith and a tongue on each of opposite ends of the respective filler panels, said latter tongues being generally V-shaped in cross-section and in sliding fit relation in correspondingly shaped grooves in the upper posts associated therewith;

a platform secured to and projecting laterally from the beams into the cells associated therewith providing a top work surface at a selected height;

each cell having one wall common with the next adjacent cell and an opening into each cell providing walk through access to the cell; and at least one second group of multi-work stations as defined above, spaced a selected distance from said first group providing walk through passages therebetween.

3. A work station layout as defined in claim 2 wherein the openings to the cells are so arranged that occupant in one cell is obscured from view of the opening to another cell, either in the same group or any of the other groups thereby providing a high degree of privacy.

4. A work station layout as defined in claim 3 wherein each cell is hexagonal and wherein all of the cells are of the same size.

5. A work station layout as defined in claim 4 wherein each beam is approximately 1.5 m in length.

6. A space partitioning system providing one or more clusters of a plurality of work areas defined by walls interconnected and arranged on a hexagonal grid, each wall of said interconnected walls comprising a pair of horizontally spaced vertical lower posts and a horizontally beam detachably connected at its respective opposite ends to respective ones of said pair of spaced apart lower posts and at a position adjacent an upper end thereof, one post of said pair of lower posts of the walls that are connected to one another being a single post common to said walls at their interconnection, upper posts detachably secured to selected ones of said lower posts and projecting upwardly therefrom as a continuation thereof, said upper and lower posts each being of hexagonal outline configuration with said upper posts having a smaller cross-sectional area than said lower posts, said upper posts including grooves therein, and at least one filler panel spanning an area between two adjacent upper posts of selected ones of said walls, said filler panels being removably anchored to the upper posts associated therewith at respective opposite ends of the panel by way of said grooves in said upper posts, a lower edge of said filler panels and an upper adjacent edge of the beam associated therewith interfitting one with the other in tongue and groove internested relation and a platform secured adjacent an edge thereof to selected ones of said beams, said platforms projecting from said beam associated therewith into the work defined area providing an upper work surface therein, said filler panels providing sound and vision barriers for the users of the work areas.

7. A partition system as defined in claim 6 wherein each beam has an approximate length of 1.5 meters.

8. A partitioning system as defined in claim 6 wherein an upper edge of said beams have a first groove therein receiving a bottom edge portion of a respective one of said removable filler panels associated therewith thereby providing said tongue and groove internested relationship.

9. A partitioning system as defined in claim 8 wherein said beams include a second groove extending longitudinally therealong in a side face thereof and wherein said platforms project into said second grooves.

10. A partitioning system as defined in claim 6 including adjustably mounted feet under the lower posts for fine tuning the horizontal attitude of the assembled system.

11. A modular partitioning system providing one or more clusters of hexagonally shaped adjoining work areas, said work areas being defined by a plurality of interconnected walls arranged on a hexagonal grid, each said wall comprising a first lower vertical post, a horizontal beam detachably connected at one end thereof to said first post and at its opposite end to a second lower post, a pair of upper posts, and a filler panel, said upper posts being detachably secured to a respective one of said lower posts and projecting upwardly therefrom, said upper posts each having a vertically disposed groove, opposite ends of said filler panel having tongues that interlock with said grooves in sliding fit relation therewith, a lower edge of said filler panel and an upper edge of said beam having inter-fitting tongue and groove portions extending the length of the panel, said posts being hexagonally shaped in outline cross-sectional view with the upper posts being of smaller outer cross-sectional dimension than the lower posts, said beam having a length corresponding to the length of one side of the hexagon and a platform having an edge thereof secured to said beam and projecting therefrom, said platform providing an upper work surface within a defined work area.

12. A partition system for dividing a space into a plurality of adjoining defined work areas arranged on a hexagonal grid of selected unit size, said partition system including lower posts, upper posts, beams and filler panels that form removably interconnected walls with one another with each wall having a length equal to one side of the hexagon of the hexagonal grid, each said wall comprising a first lower vertically disposed post, a horizontally disposed beam removably secured at one end thereof to said first power post and at the opposite end thereof to a second lower post of an adjoining wall, an upper post detachably secured to a respective one of each of said lower posts and projecting upwardly therefrom as a continuation thereof, said upper and lower posts being of hexagonal outline shape in cross-sectional view, a filler panel slidingly inserted between said upper posts spanning the area therebetween, a lower portion of said filler panel and an upper portion of the beam associated therewith being internested in tongue and groove relation along the length of the beam and platforms secured to respective selected ones of said beams and projecting horizontally therefrom into a work area associated therewith providing a work surface therein.

13. A partitioning system as defined in claim 12 including contiguous channels in the posts and beams for stringing communication and power wiring therethrough to the respective work areas.

* * * * *